United States Patent [19]

Kamp

[11] 4,426,029

[45] Jan. 17, 1984

[54] SAFETY BLADE FOR SEVERING STRETCHABLE FILM

[75] Inventor: Ewald A. Kamp, Chicago, Ill.

[73] Assignee: Union Carbide Corporation, Danbury, Conn.

[21] Appl. No.: 335,615

[22] Filed: Dec. 30, 1981

[51] Int. Cl.[3] ..... B26D 1/02; B65D 85/671

[52] U.S. Cl. ..... 225/49; 225/43; 225/48; 225/91

[58] Field of Search ..... 225/48–50, 225/91, 92, 43; 83/622, 688

[56] References Cited

U.S. PATENT DOCUMENTS

| | | | |
|---|---|---|---|
| 21,657 | 10/1858 | David | 83/622 |
| Re. 23,129 | 6/1949 | Borden | 225/91 X |
| Re. 25,876 | 10/1965 | Buttery et al. . | |
| Re. 28,911 | 7/1976 | Jespersen et al. . | |
| 293,349 | 2/1884 | Newbury . | |
| 1,841,732 | 1/1932 | Hausman | 225/92 X |
| 1,915,736 | 6/1933 | Hurlbut . | |
| 1,917,376 | 7/1933 | Lee et al. . | |
| 2,750,669 | 6/1956 | Hohmann . | |
| 2,861,753 | 11/1958 | Sipior . | |
| 2,920,342 | 1/1960 | Spang et al. . | |
| 3,082,922 | 3/1963 | Warp . | |
| 3,088,640 | 5/1963 | Kunsch . | |
| 3,173,590 | 3/1965 | Bahnsen . | |
| 3,547,328 | 12/1970 | Bjorklund et al. . | |
| 3,552,614 | 1/1971 | Wilson et al. . | |
| 3,567,087 | 2/1971 | Schramm . | |
| 3,590,695 | 7/1971 | Gerard . | |
| 3,885,724 | 5/1975 | Ehrlund | 225/91 X |
| 4,064,776 | 12/1977 | Walitalo et al. . | |
| 4,283,820 | 8/1981 | Willinger . | |
| 4,352,309 | 10/1982 | Thalström et al. | 83/622 X |

FOREIGN PATENT DOCUMENTS

| | | |
|---|---|---|
| 651689 | 10/1937 | Fed. Rep. of Germany . |
| 497951 | 12/1970 | Sweden . |
| 488543 | 7/1938 | United Kingdom . |
| 812647 | 4/1959 | United Kingdom . |

OTHER PUBLICATIONS

A photocopy of a German Kitchen Knife being employed and used in Europe.

*Primary Examiner*—Frank T. Yost
*Attorney, Agent, or Firm*—Cornelius F. O'Brien

[57] ABSTRACT

A severing blade comprising a plurality of spaced-apart sharp piercing teeth disposed below and between a plurality of spaced-apart blunt projections, the blunt projections being adapted to stretch and/or thin a segment of a sheet material, such as stretchable film, to be severed.

17 Claims, 15 Drawing Figures

FIG. 1
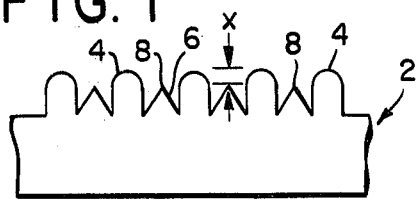
FIG. 3A
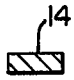
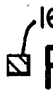
FIG. 3B
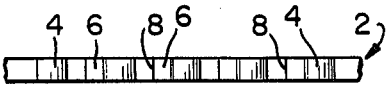
FIG. 2
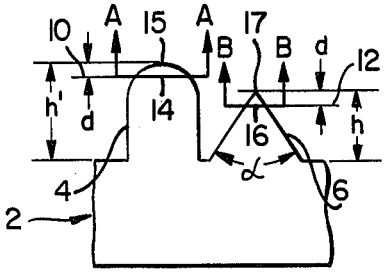
FIG. 3
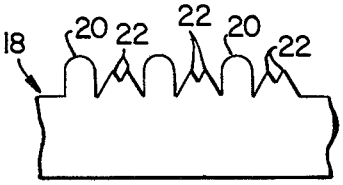
FIG. 4
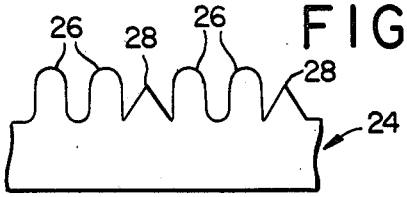
FIG. 5
FIG. 6
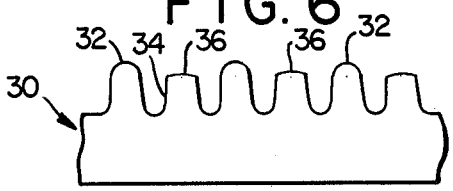
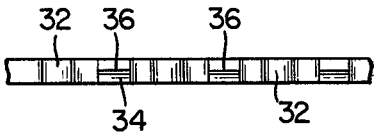
FIG. 7
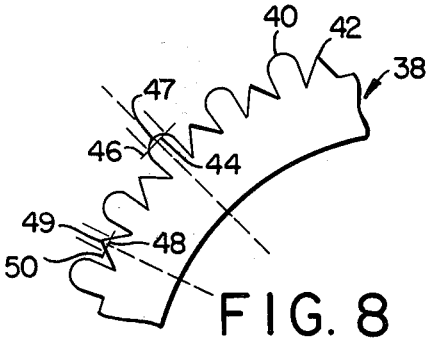
FIG. 8

FIG. 9
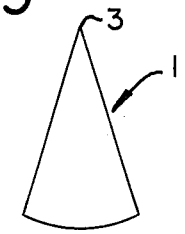
FIG. 10
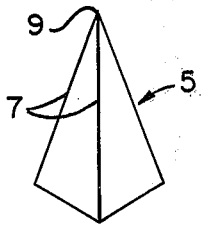
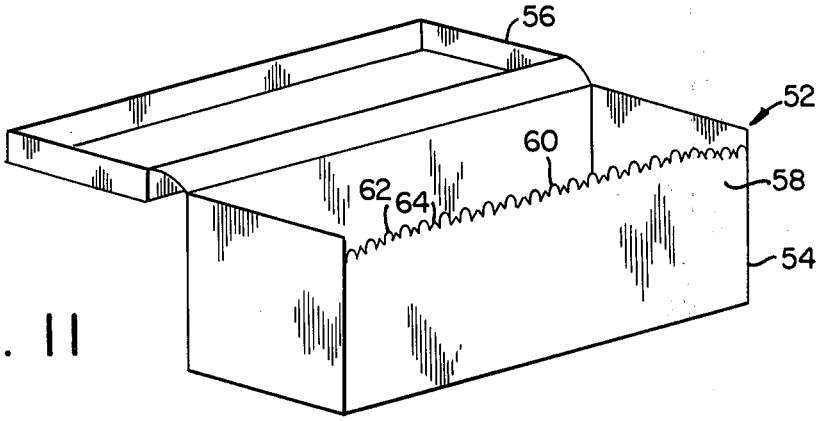
FIG. 11
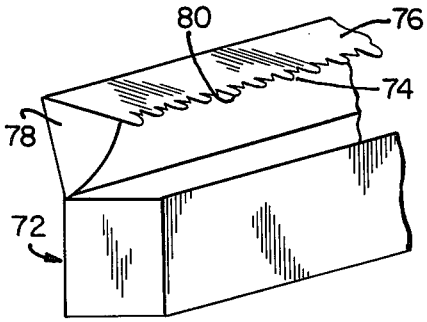
FIG. 13
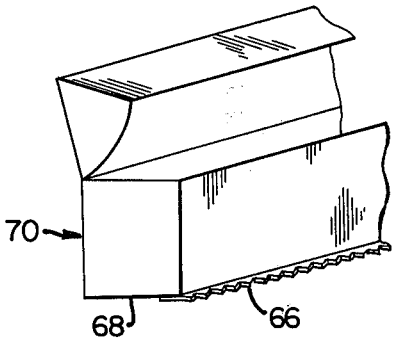
FIG. 12

SAFETY BLADE FOR SEVERING STRETCHABLE FILM

FIELD OF THE INVENTION

The invention relates to a severing blade suitable for use in severing of sheet material packaged within a rolled-sheet dispenser. Specifically, the blade comprises a plurality of spaced-apart sharp piercing teeth disposed between and below a plurality of spaced-apart blunt projections so as to provide means for stretching and/or thinning a segment of a sheet material, such as film, to be severed.

BACKGROUND OF THE INVENTION

It is known to dispense rolled-sheet material, such as waxed paper, metal foil, and the like from a rectangular container through an elongated opening. To facilitate the tearing or severing of a segment of sheet material dispensed from the container, one edge of the opening in the container usually has conventional tooth means. Generally, the tooth or severing means comprises an enlongated cutter bar having a plurality of spaced-apart conventional cutting teeth. This cutting bar is secured to an edge disposed proximal the opening in the container so that segments of the sheet material dispensed through the opening could be quickly and easily severed from the roll. The low tear strength of many of these conventional sheet materials required only a slightly sharp edge.

The advent of plastic film for consumer use as household food wraps has produced various plastic films having high strength and stretch characteristics. These new plastic films were unsuitable for conventional severing means employing slightly sharp edges and therefore cutter bars with sharp points or sharp side edges were contemplated. To be suitable for consumer use these devices usually required a guard or other safeguard means to protect a user from injury. In addition, the cost of these cutter bars and protection means are relatively high when compared to the overall cost of the dispenser in which the film is packed, thus rendering them economically unsuitable for consumer use.

Of the new household food wraps on the market, high stretch capability and high strength have been found to be desirable characteristics which render the wraps ideally suited for household consumer use. Thus the desirable properties of film-type food wraps include the following:

1. "Cling"—how well the film stays wrapped around food such as sandwiches and adheres to open containers for food such as glass bowls.
2. High strength characteristics such as tensile strength, puncture resistance and Elmendorf tear.
3. High stretch capability—how readily the film may be stretched and elongated without breakage.
4. Good handleability—how well the film resists tangling during use.
5. "Cutter bar tear"—how easily a length of the film may be withdrawn from a carton and severed by ripping or cutting on the carton's cutter bar.

The cling property is typically enhanced by the use of cling additive(s) in the film. Also, the film-type food wraps are customarily produced in thin gauges such as 0.5 mil in thickness, for economy and to provide a limpness so that the film may conform to the various shapes of packaged or wrapped containers, bowls and foods. With such thin film, toughness becomes a problem and manufacturers of film-type food wraps are constantly seeking to improve this property.

Consumers are also interested in the ease of dispensing and tearing off a sheet of film as it is withdrawn from the container that the film is packaged in. For this purpose, containers such as cartons are ordinarily provided with sharp edges, usually, a saw-tooth edge, known as a cutter bar. Manufacturers have attempted to comply with this consumer demand by supplying film that can be withdrawn from a container to a desired length and severed along the cutter bar with ease.

With the introduction of "linear" low density polyethylene made by low pressure processes (hereinafter referred to as "LPLDPE"), attempts have been made to substitute this material for cling wrap film applications in place of conventional highly branched low density polyethylenes made by high pressure processes (hereinafter referred to as "HPLDPE"). The reason for these efforts is that LPLDPE is widely recognized as being tougher and stronger than HPLDPE (reference: "Process Engineering News", February 1980, pg. 33). However, it has been determined that typical film grade LPLDPE does not provide one of the important properties required in cling wrap plastic films—ease in cutter bar tear off. Even at 0.5 mils thickness, LPLDPE film is very difficult and in some instances impossible to tear off in the transverse direction of the film on conventional cutter bar strips. The film tends to elongate, and considerable effort and energy are required to sever the film.

Other tough, stretchy plastic films, such as ethylene copolymers and terpolymers, and plasticized vinyls, are also difficult or impossible to tear on conventional cutter bars. It is also well known to the art that high pressure polyethylenes can be given increased stretch and toughness by blending them with other polymers such as ethylene vinyl acetate.

Suitable cling-wrap polyethylene film is disclosed in U.S. patent application Ser. No. 264,092 filed on May 15, 1981 in the name of E. N. Biel. The disclosure in this application is incorporated herein by reference. Although this disclosure recommends the use of low pressure-low density polyethylene in the range of between about 5 and about 16 weight percent of the LPLDPE plus HPLPDE total weight, higher amounts of LPLDPE can be employed to increase the strength and stretchability of the film for use in a wide range of applications.

It is an object of the present invention to provide a blade having a plurality of spaced-apart sharp cutting teeth disposed below and between a plurality of spaced-apart projected blunt members that is ideally suited for use in the safe severing of sheet material such as stretch film.

Another object of the present invention is to provide a blade ideally suited for severing plastic film having high strength characteristics and high stretch capability.

Another object of the present invention is to provide a blade ideally suited for use as a severing means adapted to be attached proximal an elongated opening in a rectangular container housing a roll of sheet material.

Another object of the present invention is to provide a blade for severing tough, stretchy, or tear resistant films, which has a build-in safety means to protect against accidental injury to the user.

Other features and advantages of this invention will be apparent from the following description taken in conjunction with the accompanying drawings.

SUMMARY OF THE INVENTION

The invention broadly relates to a blade for use in the severing of sheet material having a severing edge comprising a plurality of spaced-apart piercing teeth and a plurality of spaced-apart blunt projections which extend higher than the piercing teeth and are dispersed among said sharp piercing teeth so as to provide means for securing, stretching, stressing and/or thinning a segment of film to be severed.

For straight line or longitudinal flat blades, the cross-sectional area of the blunt projection formed by a plane disposed perpendicular to the plane of the blade and intersecting the blunt projection 0.0025 inch below its extremity should be at least two times larger than the cross-sectional area of the sharp tooth formed by a plane disposed perpendicular to the plane of the blade and intersecting the sharp tooth 0.0025 inch below its extremity. Preferably, the cross-sectional area of the blunt projection formed by the plane should be more than five times larger than the cross-sectional area of the sharp tooth formed by the plane and more preferably more than ten times larger. The cross-sectional area of the blunt projection formed by the plane which is less than two times larger than the cross-sectional area of the sharp tooth formed by the plane would mean that the blunt projection is too sharp or the sharp tooth is too blunt for use in the blade of this invention.

The blunt projection performs the dual function of stretching and/or thinning a segment of the film to be severed while also providing a safety means protecting the user from accidently cutting himself or an object on the sharp teeth when making contact with the blade. The blunt projections should be sufficiently dull to permit securing, stretching, stressing and/or thinning of a segment of the film whereupon the sharp teeth should be sufficiently tapered or peaked to pierce the segment of the film to be severed. If the blunt projections are too sharp, they could cause injury to the user. In the preferred embodiment, the blunt projection should be located adjacent each sharp tooth so that at least the stretching and/or thinning can be uniformly distributed across the segment of the film to be severed. In addition, the position of a blunt projection adjacent a sharp tooth will provide increased safety for the user. A slight modification of the preferred embodiment would be to dispose two or more blunt projections at or near the ends of the blade to provide maximum protection against accidental injury to the user when handling the blade.

For blades having circular or arcuate segments, the cross-sectional area of the blunt projection in the arcuate section of the blade which is formed by a plane parallel to the tangential plane of the arcuate section and intersecting the blunt projection 0.0025 inch below its extremity should be at least two times larger than the cross-sectional area of the sharp tooth in the arcuate section of the blade which is formed by a plane parallel to the tangential plane of the arcuate section intersecting the sharp tooth 0.0025 inch below its extremity. Preferably, this cross-sectional area of the blunt projection formed by the plane should be more than five times larger, and more preferably more than ten times larger, than the cross-sectional area of the sharp tooth formed by the plane for the same reason discussed above for flat blades.

The relative sharpness and dullness of the teeth and projections, respectively, should be such that when the blunt projection is directed against a 0.5 mil thick plastic film containing 100% HPLDPE (having a melt index of about 2.5 and a density of about 0.927) along with a cling additive of about 0.8 wt. % glycerol monoleate, the force required to pierce the film will be at least two times greater than the force required for the sharp tooth to pierce the film. Preferably, the force required for the blunt projection to pierce the film should be more than four times greater than the force required by the sharp tooth.

Preferably for the blades intended for consumer type rolled-sheet dispensers, the blunt projections should extend above an adjacent sharp piercing tooth by at least 0.003 inch and more preferably between about 0.005 inch and about 0.015 inch depending on the type of film or sheet material to be severed. If the extended blunt projection is too high with respect to the sharp teeth, then the sharp piercing teeth will not be properly disposed to efficiently and easily puncture the sheet material to be severed. On the other hand, if the blunt projections are too low, the sharp teeth will be exposed to cause possible injury to the user.

The blade of this invention is ideally suited to be a component of a conventional rolled-sheet dispenser adapted for packaging and dispensing of a roll of sheet material, such as stretchable food wrap. The blade can be positioned at a variety of locations on a carton so that dispensed portions of the film can be easily severed by the blade for consumer use.

The blade of this invention can be made from any rigid material such as steel, other metals, molded or stamped plastic, plastic reinforced paper or paper base materials, and the like. Preferably, the blade should be made of a metal such as steel since these materials are suitable for conventional machinery and/or stamping operations.

The shape of the sharp piercing teeth can be of any configuration such as triangular, pyramidal, conical and the like as long as the upper edge extremity of each tooth is sharp enough to pierce a segment of film to be severed. In a like manner, the blunt projections can be of any configuration such as arcuate, curved, flat or any polygonal shape as long as the upper edge extremity of each projection is dull enough to stretch and/or thin a segment of film to be severed and not too sharp to be unsafe.

BRIEF DESCRIPTION OF THE DRAWINGS

FIG. 1 is a sectional side view of a blade having a plurality of blunt projections disposed above and between a plurality of sharp piercing teeth in accordance with this invention.

FIG. 2 is a plan view of the blade shown in FIG. 1.

FIG. 3 is an enlarged side view of a section of the blade illustrated in FIG. 1 showing a blunt projection adjacent a sharp piercing tooth.

FIG. 3A is a sectional view taken through line 3A—3A.

FIG. 3B is a sectional view taken through line 3B—3B.

FIG. 4 is a sectional side view of another embodiment of a blade of this invention having dual-tooth piercing members.

FIG. 5 is a sectional side view of another embodiment of a blade of this invention having two adjacent blunt projections disposed between a pair of sharp piercing teeth.

FIG. 6 is a sectional side view of another embodiment of a blade of this invention having the sharp extremity of the teeth disposed parallel to the longitudinal axis of the blade.

FIG. 7 is a plan view of the blade shown in FIG. 6.

FIG. 8 is a sectional side view of a circular blade in accordance with this invention.

FIG. 9 is a perspective view of a conical sharp tooth for use on a blade of this invention.

FIG. 10 is a perspective view of a pyramidal sharp tooth for use on a blade of this invention.

FIG. 11 is a sectional perspective view of a rolled-sheet dispenser having a blade of this invention formed as an integral part of the dispenser.

FIG. 12 is a sectional perspective view of a rolled-sheet dispenser having a blade of this invention secured to one edge of the dispenser.

FIG. 13 is a sectional view of a rolled-sheet dispenser having a blade of this invention formed as an integral part of the dispenser.

Referring to FIGS. 1, 2 and 3, a blade 2 is shown having a plurality of spaced-apart blunt projections 4, each disposed adjacent to and above a sharp piercing tooth 6. As illustrated in FIGS. 1 and 2, the sharp teeth 6 are formed into triangles such that their upper extremities are sharp edges 8 aligned normal to the axis of blade 2. Blunt projections 4 have curved upper extremities without any sharp edges. As shown in FIGS. 3A and 3B, the cross-sectional area 14 (FIG. 3A) of each blunt projection 4 formed by a plane 10 perpendicular to the plane of the blade and intersecting the blunt projection 0.0025 inch (d) below its extremity 15 is substantially greater than the cross-sectional area 16 (FIG. 3B) formed by a plane 12 perpendicular to the plane of the blade and intersecting the sharp tooth 0.0025 inch (d) below its extremity 17. In FIG. 1, the blunt projections 4 are shown extended above teeth 6 by a distance X. In the preferred embodiment, the height (h) of the sharp teeth 6 should be between about 0.04 inch and 0.08 inch and the included angle $\alpha$ should be between 30° and 90°. The blunt projections 4 should preferably have a height (h') of between 0.045 inch and about 0.095 inch. The configuration of a blade, as shown in FIGS. 1 to 3, would be ideally suited for severing high strength and high stretch plastic film wrap. The blade embodiment shown in FIGS. 1 to 3 could be modified slightly by rounding off the sharp edges 8 on teeth 6.

FIG. 4 illustrates another embodiment of a blade 18 having a plurality of blunt projections 20, each spaced adjacent a dual-edge sharp tooth 22. In FIG. 5, another embodiment of a blade 24 is shown in which two adjacent blunt projections 26 are disposed on each side of a sharp tooth 28.

FIGS. 6 and 7 illustrate another embodiment of a blade 30 having a plurality of spaced-apart blunt projections 32 similar to those shown in FIG. 1 and identified with reference number 4. Disposed between and below two blunt projections 32 is a sharp tooth 34 which has been machined or molded on its longitudinal sides to provide a sharp extremity 36, which is disposed parallel to the longitudinal axis of the blade 30.

FIG. 8 illustrates a section of curved blade 38 having a plurality of blunt projections 40, each spaced apart between and above a plurality of sharp teeth 42. The configuration of blunt projections 40 and teeth 42 are similar to those presented in FIGS. 1 to 3. As shown in FIG. 8, the cross-sectional area 44 formed by a plane 46 parallel to the tangential plane of the curve and intersecting the blunt projection 0.0025 inch below its extremity 47 is substantially larger than cross-sectional area 48 formed by a plane 50 parallel to the tangential plane of the curve and intersecting the sharp tooth 0.0025 inch below its extremity 49.

FIG. 9 shows a single tooth 1 having a conical configuration terminating with a point 3 which could be used as the piercing means for the blade of this invention. Similarly, FIG. 10 shows a single tooth 5 having a pyramidal configuration with sharp edges 7 and terminating with a point 9 which could also be used as the piercing means for the blade of this invention.

FIG. 11 illustrates a rolled sheet dispenser 52 having a container compartment 54 and cover 56. The front side wall 58 of compartment 54 has a severing edge 60 formed as an integral part of the wall and having a plurality of spaced apart blunt projections 62 disposed above and between spaced-apart short teeth 64 of the type shown in FIGS. 1 to 3. The severing means could be a separate blade 66 secured to the bottom wall 68 of a rolled-sheet dispenser 70 as basically shown in FIG. 12. Alternately, FIG. 13 shows a rolled-sheet dispenser 72 in which the edge 74 of the front wall 76 of cover 78 is formed into a blade configuration 80 having a severing means of the type shown in FIGS. 1 to 3. Although not shown, a blade of the type shown in FIGS. 1 to 3 could be fastened to the edge of cover 78 in a conventional manner. In the preferred embodiment of the invention, the blunt projections and sharp teeth should extend completely beyond the edge of the compartment or cover of the dispenser. In the embodiments illustrated in FIGS. 11 to 13, a rolled-sheet of plastic food wrap could be placed into the container and then portions of the wrap could be dispensed from the container. With the cover in the closed position, the desired length of wrap could be forced against the cutter bar or blade, whereupon the portion of wrap could be quickly, safely and efficiently severed from the roll. The blunt projections would serve the dual function of stretching and/or thinning the segment of the film to be severed while also providing a protective barrier for the sharp teeth so as to prevent accidental injury to the user.

EXAMPLE

An Instron apparatus (Model 1130 obtained from the Instron Corporation at 2500 Washington St., Canton, Mass. 02021) was used to determine the load and force required to sever a section of different types of film when the film is forced across a cutter bar. The apparatus was used to secure the cutter bar (blade) in one Instron jaw at an angle of 30 degrees or 45 degrees from the horizontal and then a five inch by fourteen inch section of a film was looped over the cutter bar with the ends of the film held by the other Instron jaw. The Instron crosshead was activated causing the film to be pulled over the cutter bar until severed and the energy (in inch-pounds) and the load (in pounds) to sever the film was measured. Functionally, lower values of force required to sever the film are desirable from a consumer usage.

Several types of stretchable cling film were produced as shown in Table 1. Each film included 0.8% glycerol monoleate as a cling additive, and the mixtures were prepared by conventional hot processing in a 25 lb. batch size Banbury-type mixer. The mixtures were then slot cast according to conventional extrusion techniques using a 2½-inch (barrel diameter) machine equipped with a 30-inch slot die.

TABLE 1

| Sample Film | LPLDPE* (Polyethylene Weight) | HPLDPE** (Polyethylene Weight) |
|---|---|---|
| ***A | | 100% |
| B | | 100% |
| C | 30% | 70% |
| D | 50% | 50% |
| E | 100% | |

*LPLDPE having a melt index of 1.0 and density of 0.918
**HPLDPE having a melt index of 2.5 and density of 0.927
***Commercially available as GLAD (Trademark for polyethylene film) Wrap from Union Carbide Corporation.

Each sample film was pulled over a conventional severing edge (control) of the type used on household dispensing cartons, said severing edge employing a plurality of uniformly disposed sharp teeth. In a similar manner, each sample of film was pulled over a severing edge of this invention, said severing edge being as basically shown in FIGS. 1 to 3. With the severing edge held at a 30-degree angle from the horizontal, the energy and load required to sever each sample were measured and are shown in Table 2. In a like manner, with the severing edge held at a 45-degree angle from the horizontal, the energy and load required to sever each sample were measured and are shown in Table 3. As evident from the data presented in Table 2 and 3, the blade of this invention can easily, safely and efficiently sever tough, stretchy, tear resistant film.

TABLE 2

| | Cutter Bar at 30° | | | |
|---|---|---|---|---|
| | Control Cutter Bar | | Cutter Bar of This Invention | |
| Film Sample | Load (lbs) | Energy (in. lbs) | Load (lbs) | Energy (in. lbs) |
| A | 1.3 | 4.4 | 0.4 | 1.1 |
| B | 0.4 | 1.2 | 0.3 | 0.9 |
| C | 0.6 | 1.7 | 0.5 | 1.3 |
| D | >10.0 | — | 0.6 | 1.8 |
| E | >10.0 | — | 2.7 | 7.5 |

3

| | Cutter Bar at 45° | | | |
|---|---|---|---|---|
| | Control Cutter Bar | | Cutter Bar of This Invention | |
| Film Sample | Load (lbs) | Energy (in. lbs) | Load (lbs) | Energy (in. lbs) |
| A | 0.4 | 1.5 | 0.3 | 1.0 |
| B | 0.3 | 1.3 | 0.2 | 0.8 |
| C | 0.5 | 1.9 | 0.3 | 1.2 |
| D | 0.8 | 3.0 | 0.4 | 1.5 |
| E | 7.8 | 37.0 | 1.0 | 4.5 |

What is claimed:

1. A blade for use in the severing of sheet material having a severing edge comprising a plurality of spaced-apart piercing teeth and a plurality of spaced-apart blunt projections which extend higher than the piercing teeth and are dispersed among said sharp piercing teeth so as to provide means for stretching and/or thinning a segment of film to be severed.

2. The blade of claim 1 wherein the severing edge is substantially straight and wherein the cross-sectional area of the blunt projection which is formed by a plane perpendicular to the plane of the blade and intersecting the blunt projection 0.0025 inch below its extremity is at least two times larger than the cross-sectional area of the sharp tooth which is formed by a plane perpendicular to the plane of the blade and intersecting the sharp tooth 0.0025 inch below its extremity.

3. The blade of claim 2 wherein said cross-sectional area of the blunt projection is at least five times larger than said cross-sectional area of the sharp tooth.

4. The blade of claim 1 wherein the severing edge has at least one arcuate section and wherein the cross-sectional area of the blunt projection which is formed by a plane parallel to the tangential plane of the arcuate section of the blade and intersecting the blunt projection 0.0025 inch below its extremity is at least two times larger than the cross-sectional area of the sharp tooth which is formed by a plane parallel to the tangential plane of the arcuate section of the blade and intersecting the sharp tooth 0.0025 inch below its extremity.

5. The blade of claim 4 wherein said cross-sectional area of the blunt projection is at least five times larger than the cross-sectional area of the sharp tooth.

6. The blade of claims 1, 2, 3, 4 or 5 wherein the blunt projections extend above an adjacent sharp piercing tooth between about 0.003 inch and about 0.015 inch.

7. The blade of claims 1, 2 or 4 wherein at least one sharp piercing tooth is positioned between two blunt projections.

8. The blade of claims 1, 2 or 4 wherein the blunt projections are uniformly distributed along the edge of the blade and at least one sharp piercing tooth is positioned between every pair of adjacent blunt projections.

9. The blade of claim 1 made of a material selected from the group consisting of metals, plastics, and paper base materials.

10. A dispenser box adapted for receiving a rolled-sheet of material, said box comprising a container compartment having side, end and bottom walls and a cover for the walls, a blade disposed on the dispenser box so that portions of the sheet material can be dispensed from the box and severed across the blade, the improvement comprising said blade having a plurality of spaced-apart piercing teeth and a plurality of spaced-apart blunt projections which extend higher than the piercing teeth and are dispersed among said sharp piercing teeth so as to provide means for stretching and/or thinning a segment of the sheet material to be severed.

11. The dispenser box of claim 10 wherein the severing edge is substantially straight and wherein the cross-sectional area of the blunt projection which is formed by a plane perpendicular to the plane of the blade and intersecting the blunt projection 0.0025 inch below its extremity is at least two times larger than the cross-sectional area of the sharp tooth which is formed by a plane perpendicular to the plane of the blade and intersecting the sharp tooth 0.0025 inch below its extremity.

12. The dispenser box of claim 11 wherein said cross-sectional area of the blunt projection is at least five times larger than said cross-sectional area of the sharp tooth.

13. The dispenser box of claim 10 wherein the severing edge has at least one arcuate section and wherein the cross-sectional area of the blunt projection which is formed by a plane parallel to the tangential plane of the arcuate section of the blade and intersecting the blunt projection 0.0025 inch below its extremity is at least two times larger than the cross-sectional area of the sharp tooth which is formed by a plane parallel to the tangential plane of the arcuate section of the blade and intersecting the sharp tooth 0.0025 inch below its extremity.

14. The dispenser box of claim 13 wherein said cross-sectional area of the blunt projection is at least five times larger than the cross-sectional area of the sharp tooth.

15. The dispenser box of claim 10, 11, 12, 13, or 14 wherein the blade forms an integral part of the dispenser.

16. The dispenser box of claim 10, 11, 12, 13, or 14 wherein the blade is a separate component that is secured to the dispenser.

17. The dispenser box of claim 10, 11, 12, 13, or 14 wherein the blade is secured to an edge of the box.

* * * * *